US007802334B1

(12) United States Patent
Larios

(10) Patent No.: US 7,802,334 B1
(45) Date of Patent: Sep. 28, 2010

(54) PEST PROOF BED COVER APPARATUS

(76) Inventor: Claudia Y. Larios, 560 Main St., Apt. 408, New York City, NY (US) 10044

( * ) Notice: Subject to any disclaimer, the term of this patent is extended or adjusted under 35 U.S.C. 154(b) by 0 days.

(21) Appl. No.: 12/716,490

(22) Filed: Mar. 3, 2010

(51) Int. Cl.
*A47C 27/00* (2006.01)

(52) U.S. Cl. ..... 5/726; 5/482; 5/496

(58) Field of Classification Search ..... 5/726, 5/421, 423, 482, 496
See application file for complete search history.

(56) References Cited

U.S. PATENT DOCUMENTS 4,164,797 A 8/1979 Golembeck
4,700,418 A 10/1987 Ritter
5,321,861 A * 6/1994 Dancey et al. ..... 5/482
D583,606 S 12/2008 Mazzuca
7,552,489 B2 6/2009 Bell et al.
2002/0148047 A1* 10/2002 Corzani et al. ..... 5/738
2005/0005363 A1 1/2005 Giori et al.

* cited by examiner

*Primary Examiner*—Fredrick Conley
(74) *Attorney, Agent, or Firm*—Crossley Patent Law; Mark A. Crossley

(57) ABSTRACT

The pest proof bed cover apparatus provides a flexible, sealable, bug proof cover for both a mattress and a mattress support, such as typical box springs. The first end of the cover provides a zipping lock that properly seals against pest invasion and escape. Importantly, the apparatus also provides a properly supported fan mechanism for evacuating inside the cover so that air is removed from the mattress, mattress support, and from around and between the two, thereby suffocating pests. Additionally, pesticides can be used within the cover for even more positive pest control. The apparatus is cost effective in providing both pest control and in providing a means for sanitarily storing and transporting mattresses and mattress supports.

1 Claim, 3 Drawing Sheets

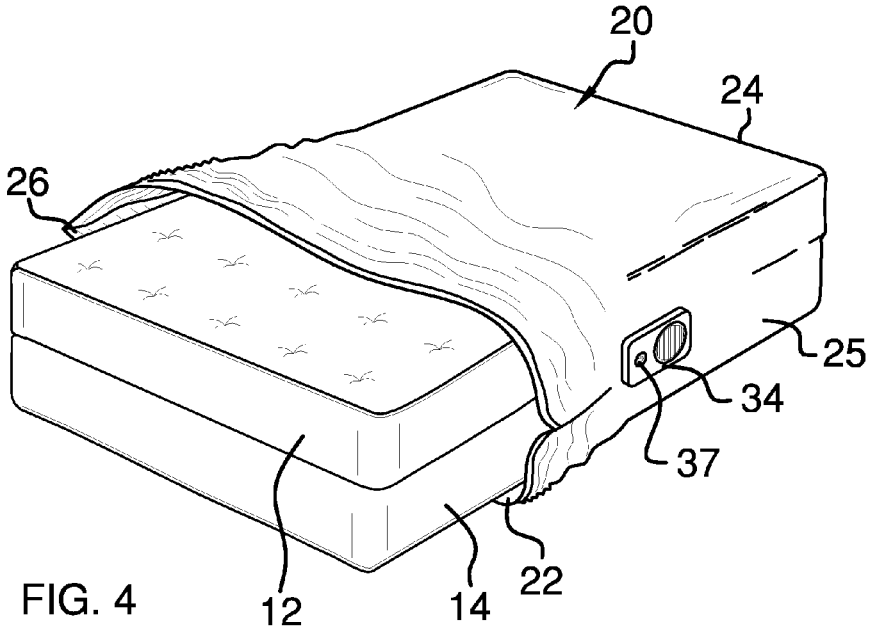
FIG. 4
FIG. 5
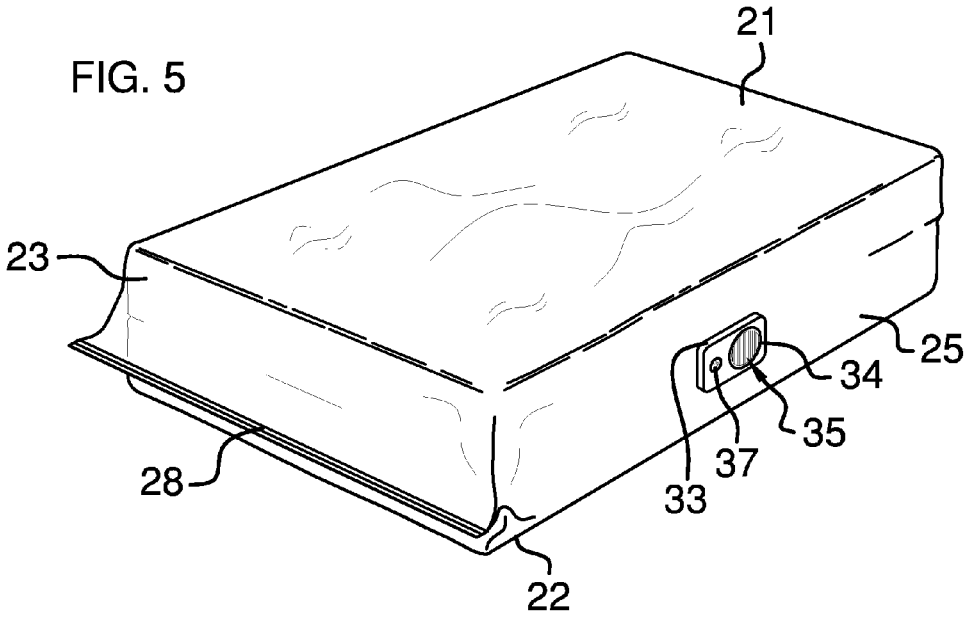

PEST PROOF BED COVER APPARATUS

BACKGROUND OF THE INVENTION

Various undesirable pests often invade beds. Perhaps the best known of such pests are *cimex lectularis*, known commonly as bed bugs. Beg bug problems have risen since the 21$^{st}$ century. The National Pest Management Association reported a 71% increase in bedbug calls between 2000 and 2005. A pest management company called The Steritch Group claim that 25% of the 700 hotels they surveyed between 2002 and 2006 needed bedbug treatments. New York City offers further bed bug problem examples with increases in annual violations occurring almost yearly since 2004.

Typically, bed bugs retreat into mattresses and mattress supports, then exit to bite those who might lie or sleep there. What has been needed is a convenient, low cost, totally effective means for addressing such pest problems. The current apparatus does so.

FIELD OF THE INVENTION

The pest proof bed cover apparatus relates to mattresses and mattress supports and more especially to a pest proof mattress and mattress support cover that can be evacuated to kill pests such as bed bugs, mites, and other unwanted living creatures that often live within mattresses and supports.

SUMMARY OF THE INVENTION

The general purpose of the pest proof bed cover apparatus, described subsequently in greater detail, is to provide a pest proof bed cover apparatus which has many novel features that result in an improved pest proof bed cover apparatus which is not anticipated, rendered obvious, suggested, or even implied by prior art, either alone or in combination thereof.

To attain this, the pest proof bed cover apparatus provides a flexible, sealable, bug proof cover for both a mattress and a mattress support, such as typical box springs. The first end of the cover provides a zipping lock that properly seals against pest invasion and escape. Importantly, the apparatus also provides a properly supported fan mechanism for evacuating inside the cover so that air is removed from the mattress, mattress support, and from around and between the two, thereby suffocating pests. Additionally, pesticides can be used within the cover for even more positive pest control.

The apparatus is cost effective in providing both pest control and in providing a means for sanitarily storing and transporting mattresses and mattress supports. Various sizes of the apparatus are provided so that a variety of mattress and mattress supports can be selectively encased.

Thus has been broadly outlined the more important features of the improved pest proof bed cover apparatus so that the detailed description thereof that follows may be better understood and in order that the present contribution to the art may be better appreciated.

An object of the pest proof bed cover apparatus is to prevent bed pests from surviving within a mattress and mattress support.

Another object of the pest proof bed cover apparatus is to prevent pest escape from a mattress and mattress support.

A further object of the pest proof bed cover apparatus is to provide an evacuation fan for evacuating air from within and around a mattress and mattress support.

An added object of the pest proof bed cover apparatus is to properly support the evacuation fan.

Yet another object of the pest proof bed cover apparatus is to provide a means for sanitarily moving and storing mattresses and mattress supports.

These together with additional objects, features and advantages of the improved pest proof bed cover apparatus will be readily apparent to those of ordinary skill in the art upon reading the following detailed description of presently preferred, but nonetheless illustrative, embodiments of the improved pest proof bed cover apparatus when taken in conjunction with the accompanying drawings.

In this respect, before explaining the current embodiments of the improved pest proof bed cover apparatus in detail, it is to be understood that the pest proof bed cover apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved pest proof bed cover apparatus. It is therefore important that the claims be regarded as including such equivalent constructions insofar as they do not depart from the spirit and scope of the pest proof bed cover apparatus. It is also to be understood that the phraseology and terminology employed herein are for purposes of description and should not be regarded as limiting.

BRIEF DESCRIPTION OF THE DRAWINGS

FIG. 4 is a perspective view of the apparatus partially installed on a mattress and mattress support.

FIG. 5 is a perspective view of the apparatus installed.

DETAILED DESCRIPTION OF THE DRAWINGS

With reference now to the drawings, and in particular FIGS. 1 through 5 thereof, the principles and concepts of the pest proof bed cover apparatus generally designated by the reference number 10 will be described.

Figure 1:
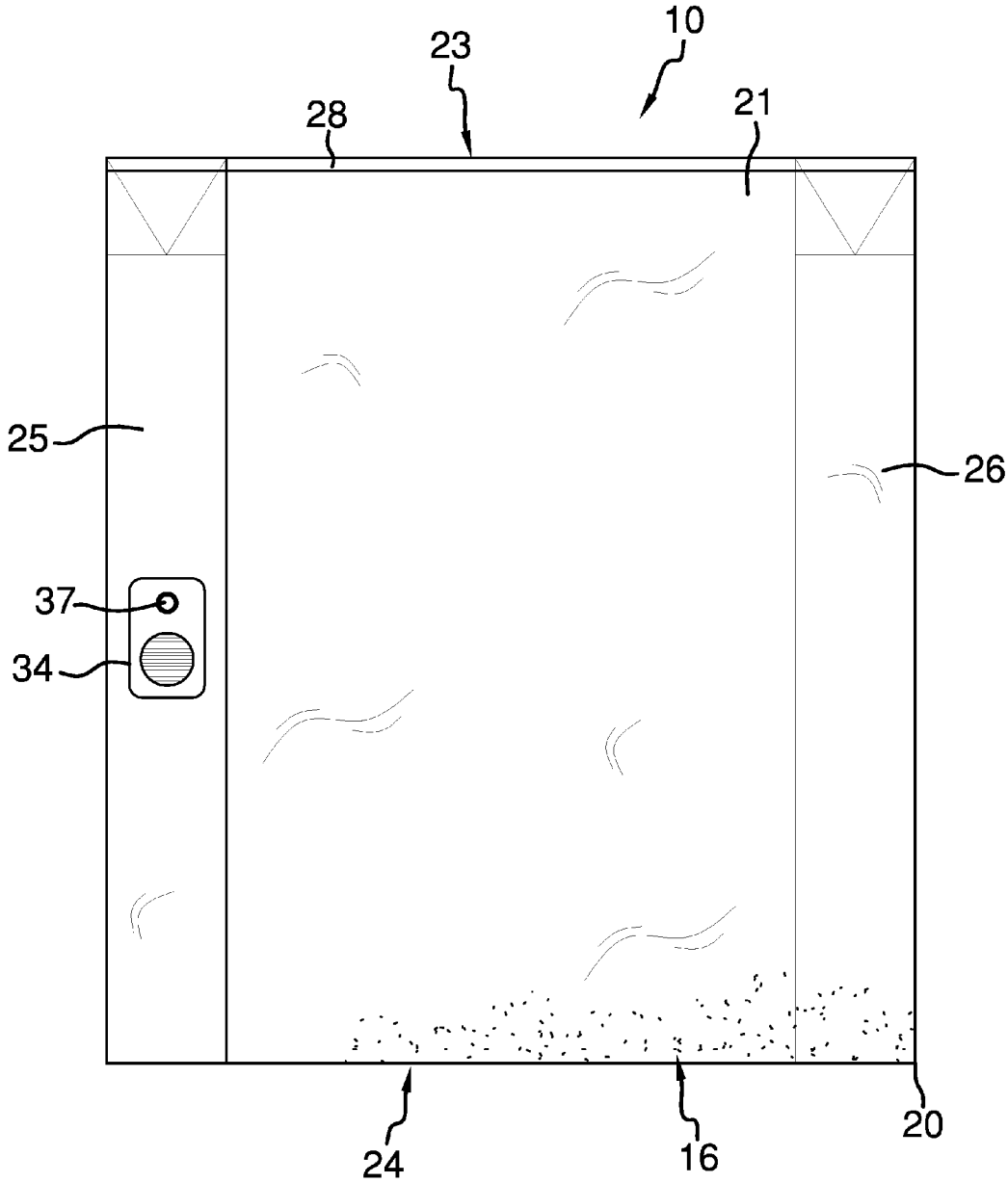
FIG. 1 is a top plan view of the apparatus in a collapsed, unused state.
Figure 2:
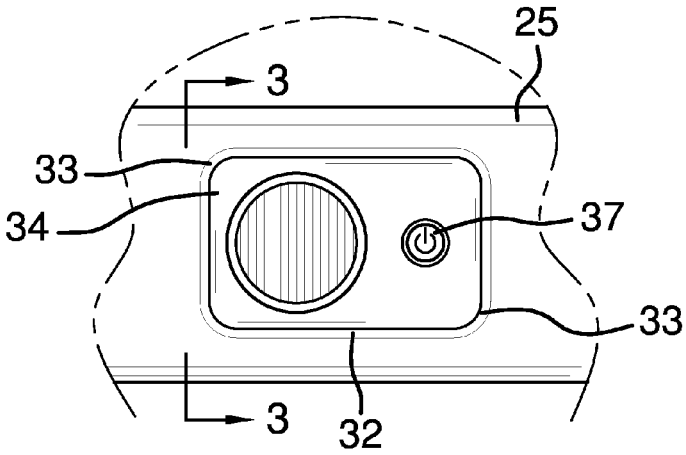
FIG. 2 is a lateral elevation view of the fan case and control disposed within one side of the apparatus.

Referring to FIG. 1 and FIG. 4, the apparatus 10 partially comprises a flexible pest proof airtight cover 20 having a top 21 spaced apart from a bottom 22, a first end 23 spaced apart from a second end 24, and a first side 25 spaced apart from the second side 26. The cover 20 is selectively fitted over an existing mattress 12 and an existing mattress support 14. Also illustrated is the use of pesticides 16 within the cover 20 to further enhance pest eradication.

Referring to FIG. 5, the cover 20 further comprises the zipping lock 28 that is disposed across the cover 20 first end 23. The zipping lock 28 forms an airtight seal when locked.

Figure 3:
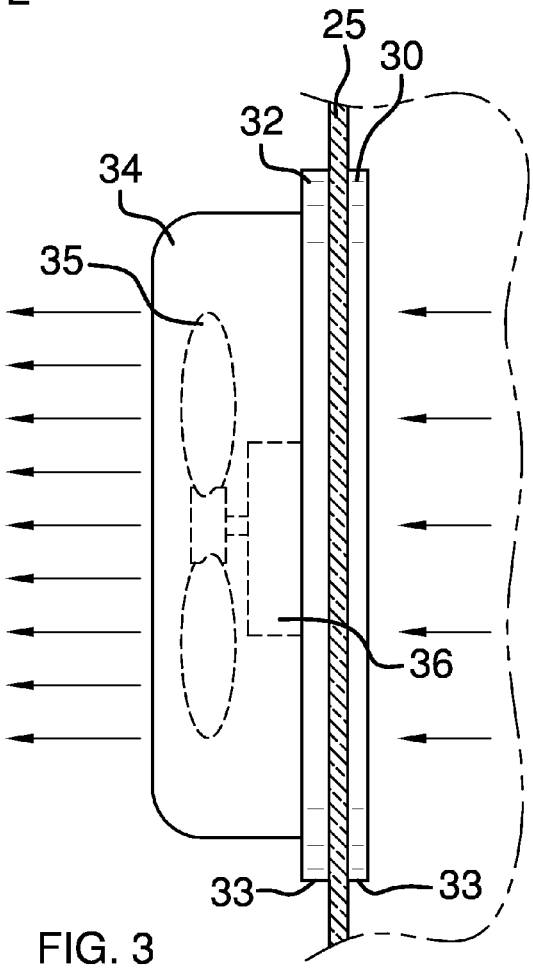
FIG. 3 is a cross sectional view of FIG. 2, taken along the line 3-3.

Referring to FIG. 3, the rectangular inner flange 30 is disposed within the cover 20 first side 25. The inner flange 30 has rounded corners 33. The rectangular outer flange 32 is disposed outwardly on the cover 20 first side 25. The outer flange 32 is disposed directly opposite the inner flange 30. The outer flange 32 has a shape and size like the shape and size of the inner flange 30. The outer flange 32 also importantly has rounded corners 33. Rounded corners 33 of the flanges ensure against cover failure, as repeated removal, installation, and storage of the flexible cover might otherwise compromise the cover 20 air tight integrity.

Referring to FIG. 2 and again to FIG. 3, the fan case 34 is affixed outwardly to the outer flange 32. The electric motor 36 is disposed within the fan case 34. The fan 35 is disposed within the fan case 34 and is driven by the electric motor 36. The control 37 is disposed exteriorly on the fan case 34 and controls the motor 36. Air is selectively evacuated from the cover 20 to form a vacuum within.

With respect to the above description then, it is to be realized that the optimum dimensional relationships for the parts of the pest proof bed cover apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the pest proof bed cover apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the pest proof bed cover apparatus may be used.

Therefore, the foregoing is considered as illustrative only of the principles of the pest proof bed cover apparatus. Further, since numerous modifications and changes will readily occur to those skilled in the art, it is not desired to limit the pest proof bed cover apparatus to the exact construction and operation shown and described, and accordingly, all suitable modifications and equivalents may be resorted to, falling within the scope of the pest proof bed cover apparatus.

What is claimed is:

1. A pest proof bed cover apparatus comprising, in combination:

a flexible pest proof airtight cover having a top spaced apart from a bottom, a first end spaced apart from a second end, a first side spaced apart from a second side, the cover selectively fitted over an existing mattress and an existing mattress support;

a zipping lock disposed across the cover first end, the zipping lock forming an airtight seal;

a rectangular inner flange disposed within the cover first side, the inner flange having rounded corners;

a rectangular outer flange disposed outwardly on the cover first side, the outer flange directly opposite the inner flange, the outer flange having a shape and size like a shape and size of the inner flange, the outer flange having rounded corners;

a fan case affixed outwardly to the outer flange;

an electric motor disposed within the fan case;

a fan disposed within the fan case, the fan powered by the electric motor;

a control disposed exteriorly on the fan case, the control in communication with the motor;

whereby air is selectively evacuated from the cover.

* * * * *